US010436472B2

(12) United States Patent
Kim et al.

(10) Patent No.: US 10,436,472 B2
(45) Date of Patent: Oct. 8, 2019

(54) AIR CONDITIONER AND METHOD OF CONTROLLING THE SAME

(71) Applicant: Samsung Electronics Co., Ltd., Suwon-si, Gyeonggi-do (KR)

(72) Inventors: Jin-Gyun Kim, Seongnam-si (KR); Tae Duk Kim, Yongin-si (KR); Weon Seok Choi, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 57 days.

(21) Appl. No.: 15/375,701

(22) Filed: Dec. 12, 2016

(65) Prior Publication Data

US 2017/0198938 A1 Jul. 13, 2017

(30) Foreign Application Priority Data

Jan. 7, 2016 (KR) ..... 10-2016-0001892

(51) Int. Cl.

| | |
|---|---|
| ***F24F 11/30*** | (2018.01) |
| ***F24F 13/12*** | (2006.01) |
| ***F24F 1/0014*** | (2019.01) |
| ***F24F 1/0033*** | (2019.01) |
| ***F24F 13/20*** | (2006.01) |
| ***F24F 1/005*** | (2019.01) |
| ***F24F 11/89*** | (2018.01) |

(52) U.S. Cl.

CPC ..... *F24F 13/12* (2013.01); *F24F 1/005* (2019.02); *F24F 1/0014* (2013.01); *F24F 1/0033* (2013.01); *F24F 11/89* (2018.01); *F24F 13/20* (2013.01)

(58) Field of Classification Search

CPC ..... F24F 11/0001; F24F 1/0011; F24F 13/10; F24F 1/0014; F24F 1/0033; F24F 13/20; F24F 13/12; F24F 2001/004; F24F 11/30

USPC ..... 454/341, 347, 339

See application file for complete search history.

(56) References Cited

U.S. PATENT DOCUMENTS

| | | | | |
|---|---|---|---|---|
| 5,563,483 | A * | 10/1996 | Kowall | E05B 81/14 318/266 |
| 2011/0250831 | A1* | 10/2011 | Huang | H05K 7/20745 454/184 |
| 2012/0194043 | A1* | 8/2012 | Turner | G07F 7/00 312/109 |
| 2014/0303852 | A1* | 10/2014 | Seki | E05F 15/75 701/49 |

FOREIGN PATENT DOCUMENTS

| | | | |
|---|---|---|---|
| JP | 04139350 | A * | 5/1992 |
| JP | 2014024627 | A * | 2/2014 |

(Continued)

*Primary Examiner* — Steven B McAllister
*Assistant Examiner* — Ko-Wei Lin
(74) *Attorney, Agent, or Firm* — Jefferson IP Law, LLP

(57) ABSTRACT

An air conditioner to prevent fingers from being jammed therein during a closing operation of an opening and a method of controlling the same are provided. The air conditioner includes a housing in which an opening is formed, a door unit provided to be movable around the opening to open or close the opening, and at least one configured to control the door unit to stop at a position spaced a preset first distance from the opening during a closing operation of the door unit and control the closing operation of the door unit.

8 Claims, 11 Drawing Sheets

(56) References Cited

FOREIGN PATENT DOCUMENTS

| | | | | |
|---|---|---|---|---|
| JP | 2015-30577 | A | | 2/2015 |
| KR | 10-2001-0037821 | A | | 5/2001 |
| KR | 10-2009-0085942 | A | | 8/2009 |
| KR | 20090085942 | A | * | 8/2009 |

* cited by examiner

AIR CONDITIONER AND METHOD OF CONTROLLING THE SAME

CROSS-REFERENCE TO RELATED APPLICATION(S)

This application claims the benefit under 35 U.S.C. § 119(a) of a Korean patent application filed on Jan. 7, 2016 in the Korean Intellectual Property Office and assigned Serial number 10-2016-0001892, the entire disclosure of which is hereby incorporated by reference.

TECHNICAL FIELD

The present disclosure relates to an air conditioner. More particularly, the present disclosure relates to an air conditioner provided to prevent fingers from being jammed therein during a closing operation of an opening and a method of controlling the same.

BACKGROUND

An air conditioner is an apparatus configured to perform indoor cooling or heating, circulates a refrigerant between an indoor unit and an outdoor unit, and performs cooling or heating operation using properties that ambient heat is absorbed when the refrigerant in a liquid state evaporates and the heat is emitted when the refrigerant is liquefied.

Recently, air conditioners, in which an opening is formed in a front surface of a main body to improve quality of an exterior thereof and the opening can be opened or closed using a door unit, are being developed.

In the case of such an air conditioner, because the opening is open while the air conditioner is used and the opening is closed while the air conditioner is not used, an opening or closing operation of the door unit is performed when an operation signal for the air conditioner is input by a user. In this case, obstacles, such as fingers of the user or other objects (hereinafter, referred to as obstacles), are jammed, and thus there is a problem in that the opening is incompletely closed, is closed in a state in which the obstacles are jammed, or the like.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an air conditioner such that closing speeds of door units are adjusted during a closing operation of opening, and a method of controlling the same.

Another aspect of the present disclosure is to provide an air conditioner such that a closing speed of a door unit are adjusted after the door unit stops at a position spaced a preset distance from an opening for a preset time during closing operation of the opening, and a method of controlling the same are provided.

Another aspect of the present disclosure is to provide an air conditioner such that door units are controlled to be sequentially closed while a plurality of openings are closed, and a method of controlling the same.

In accordance with an aspect of the present disclosure, an air conditioner is provided. The air conditioner includes a housing in which an opening is formed, a door unit provided to be movable around the opening to open or close the opening, and at least one processor configured to control the door unit to stop at a position spaced a preset first distance from the opening during a closing operation of the door unit and control the closing operation of the door unit.

The air conditioner may include the controller which controls closing speeds of the door unit before and after the door unit stops to be different.

The air conditioner may include the controller which controls a closing speed of the door unit before the door unit stops to be a preset first speed, and controls a closing speed of the door unit after the door unit stops to be a preset second speed slower than the first speed.

The air conditioner may include the controller which controls a closing speed of the door unit after the door unit stops to be slower than that of the door unit before the door stops.

The air conditioner may include the controller which controls the door unit to stop at the position spaced the preset first distance from the opening for a preset first time during the closing operation of the door unit, and controls the closing operation of the door unit.

When a plurality of openings are formed in the housing, the controller may control the closing operation of the door unit such that the openings are closed sequentially.

The air conditioner may include controller which controls the closing operation of the door unit such that the openings are sequentially closed in a direction from an upper surface to a lower surface of the air conditioner.

In accordance with another aspect of the present disclosure, the method of controlling an air conditioner, which includes a housing in which an opening is formed and a door unit configured to open or close the opening, is provided. The method includes controlling a closing operation of the door unit to have a first speed which is preset, and controlling the closing operation of the door unit to have a preset second speed when the door unit reaches a position spaced a preset first distance from the opening.

The controlling of the closing operation of the door unit to have the preset second speed may include controlling the closing operation of the door unit to have the preset second speed slower than the first speed.

When a plurality of openings are formed in the housing, the closing operation of the door unit may be controlled such that the plurality of openings are closed sequentially.

When the plurality of openings are formed in the housing, the closing operation of the door unit may be controlled such that the plurality of openings are sequentially closed in a direction from an upper surface to a lower surface of the air conditioner.

The method may further comprise controlling the door unit to stop for a preset first time when the door unit reaches the position spaced the preset first distance from the opening.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
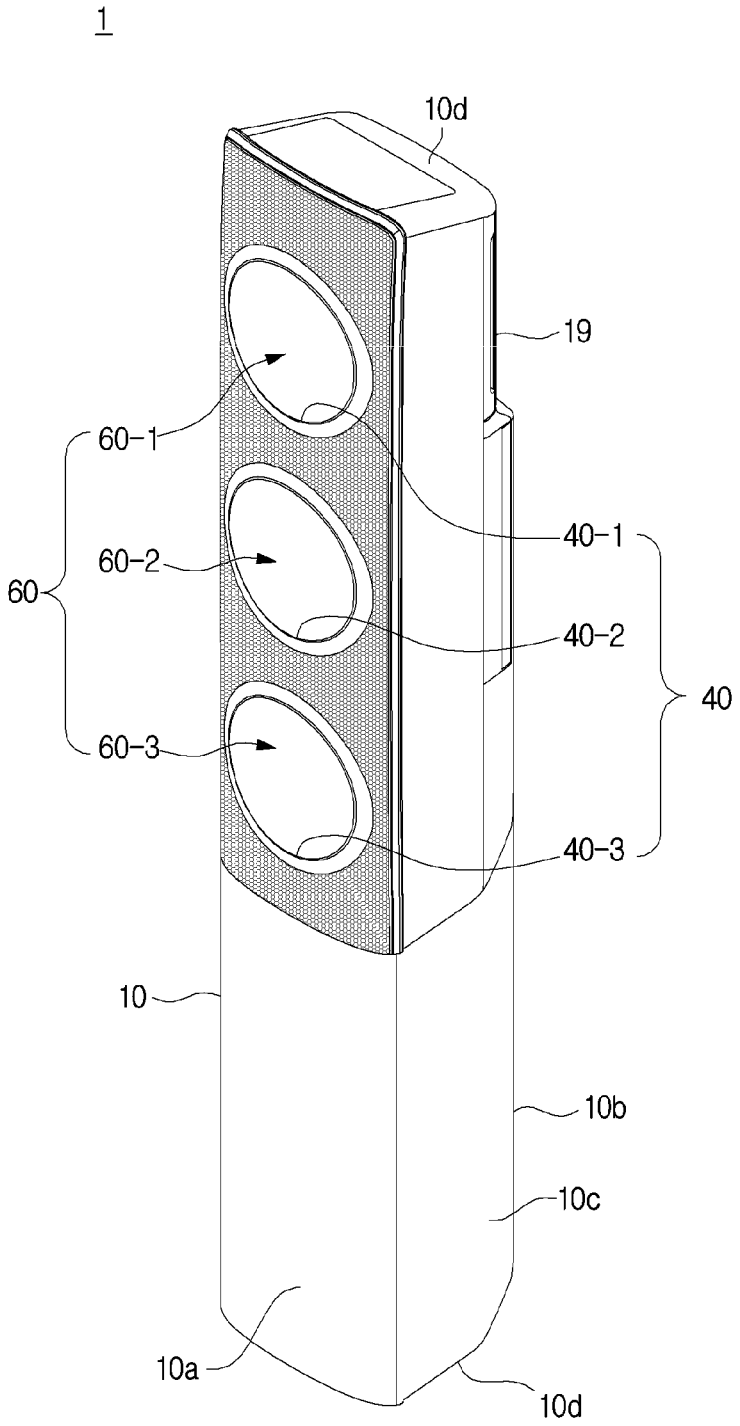
FIG. 1 is a view illustrating an exterior of an air conditioner according to an embodiment of the present disclosure.
Figure 2:
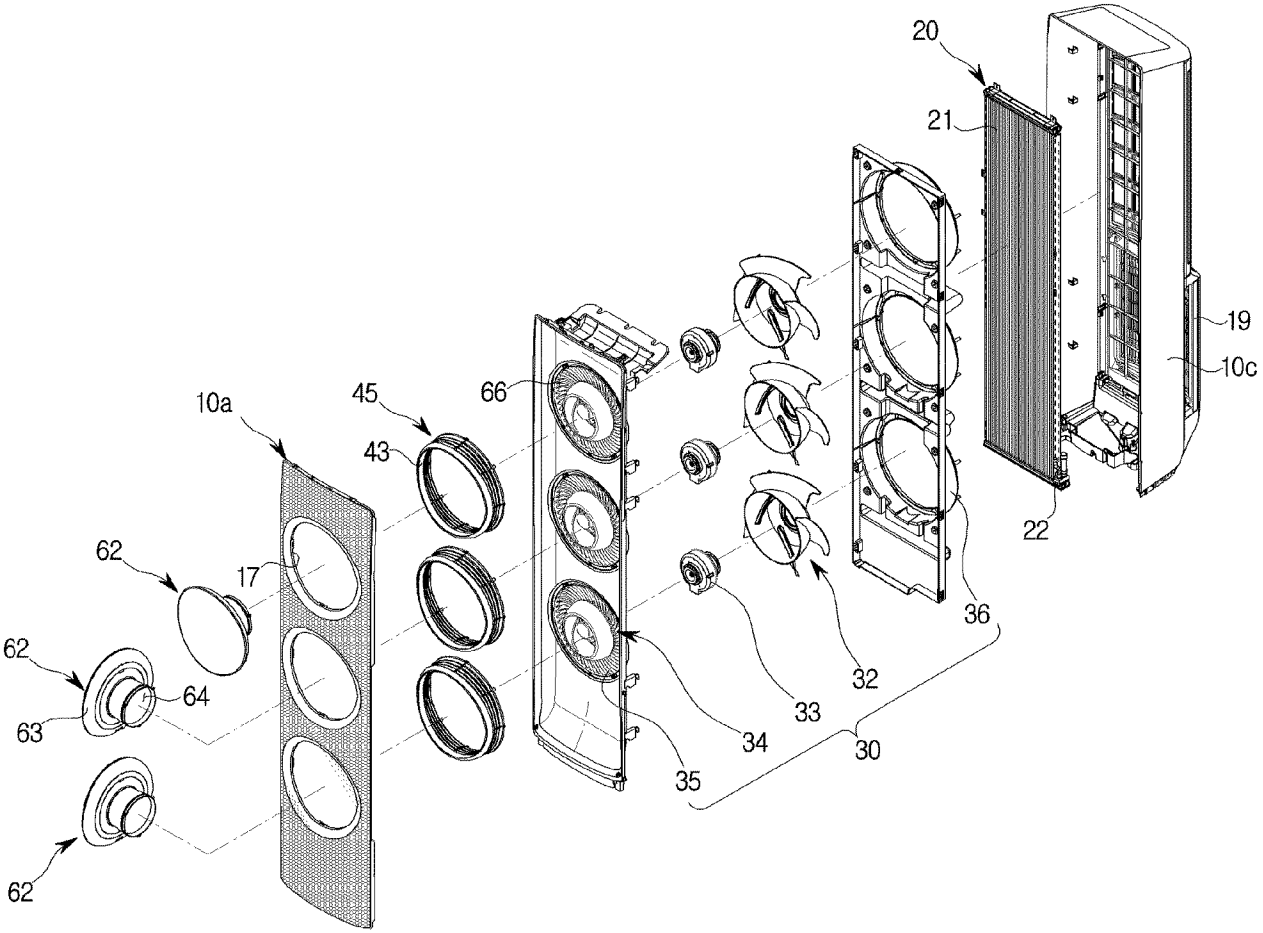
FIGS. 2 and 3 are exploded views illustrating the air conditioner according to various embodiments of the present disclosure.
Figure 3:
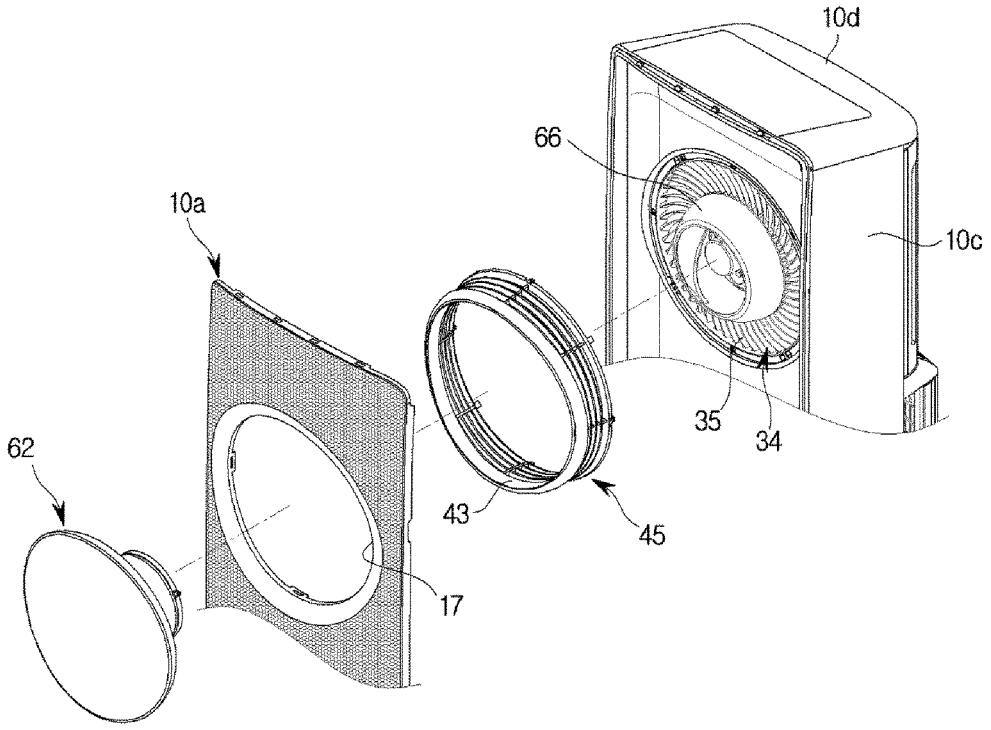

FIG. 1 is a view illustrating an exterior of an air conditioner 1 according to an embodiment of the present disclosure, and FIGS. 2 and 3 are exploded views illustrating the air conditioner 1 according to various embodiments of the present disclosure.

Referring to FIGS. 1, 2, and 3, an indoor unit of the air conditioner 1 includes a housing 10 having at least one opening 17 and forming an exterior, a heat exchanger 20 configured to exchange heat with air introduced into the housing 10, a blower unit 30 configured to circulate air into or out of the housing 10, a discharge unit 40 configured to discharge air blown from the blower unit 30 to the outside of the housing 10, and a door unit 60 provided to be movable around the opening 17 to open or close the opening 17.

The housing 10 includes a front panel 10*a* in which at least one opening 17 is formed, a rear panel 10*b* disposed behind the front panel 10*a*, side panels 10*c* provided between the front panel 10*a* and the rear panel 10*b*, and upper and lower panels 10*d* respectively disposed above and below the side panels 10*c*. At least one opening 17 may be provided in a circular shape, and at least two openings 17 may be disposed to be spaced apart in an up-down direction in the front panel 10*a*. A suction inlet 19 may be formed in the rear panel 10*b* so that outside air is suctioned into the housing 10.

The suction inlet 19 is provided in the rear panel 10*b* disposed behind the heat exchanger 20 and guides air outside the housing 10 to be introduced into the housing 10. The air introduced into the housing 10 through the suction inlet 19 absorbs or loses heat while passing through the heat exchanger 20. The air which exchanged heat while passing through the heat exchanger 20 is discharged to the outside of the housing 10 by the blower unit 30.

The heat exchanger 20 is disposed between a blower fan 32 and the suction inlet 19 and absorbs heat from air introduced through the suction inlet 19 or transfers heat to the air introduced through the suction inlet 19. The heat exchanger 20 may include tubes 21 and headers 22 coupled to upper and lower sides of the tubes 21. However, the type of heat exchanger 20 is not limited thereto. At least one heat exchanger 20 described above may be provided to correspond to the number of openings 17.

The blower unit 30 may include blower fans 32 and blower grills 34.

The blower grills 34 may be provided in a discharging direction of the blower fans 32. In the present embodiment, a mixed flow fan may be applied as each of the blower fans 32. However, the type of blower fan 32 is not limited thereto and may include any device capable of blowing air introduced from the outside of the housing 10 to be discharged to the outside of the housing 10. For example, the blower fan 32 may be provided as a cross fan, a turbo fan, or a sirocco fan. Meanwhile, the number of blower fans 32 is not limited, and in the present embodiment, at least one blower fan 32 may be provided to correspond to at least one opening 17.

Each of the blower grills 34 may be disposed in front of the blower fan 32 to guide an air flow. In addition, the blower grills 34 may also be disposed between the blower fans 32 and the discharge units 40 to minimize an external influence on the blower fan 32.

The blower grill 34 may include a plurality of blades 35. A wind direction and a flow rate of air blown to the discharge unit 40 by the blower fan 32 may be adjusted by adjusting the number, a shape, or an arrangement angle of the plurality of blades 35.

Door operating units 66 which will be described below may be provided at centers of the blower grills 34. Each of the door operating units 66 and each fan driver 33 may be disposed on the same line in a front-rear direction. Through such a structure, the plurality of blades 35 of the blower grill 34 may be provided to be positioned in front of fan blades of the blower fans 32.

Some embodiments, the blower unit 30 may also include ducts 36. Each of the ducts 36 may be formed in a circular shape which surrounds the blower fan 32, and may be provided to guide a flow of air flowing toward the blower fan 32. That is, the duct 36 may guide air which is suctioned through the suction inlet 19 and passes through the heat exchanger 20 to flow toward the blower fan 32.

In addition, the blower unit 30 may include the fan drivers 33 provided at centers of the blower fans 32 and configured to drive the blower fans 32, and the fan drivers 33 may include motors.

The discharge unit 40 is provided to discharge air, of which heat has been exchanged in the housing 10, to the outside of the housing 10. The discharge unit 40 may be provided in plurality. For example, the discharge units 40 may include a first discharge unit 40-1, a second discharge unit 40-2, and a third discharge unit 40-3.

Each of the discharge units 40-1, 40-2, and 40-3 may be provided to be opened or closed by the door unit 60. For example, the door unit 60 may include a first door unit 60-1 configured to open or close the first discharge unit 40-1, a second door unit 60-2 configured to open or close the second discharge unit 40-2, and a third door unit 60-3 configured to open or close the third discharge unit 40-3. An arrangement example of the door unit 60 is not limited thereto, the door unit 60 may be provided to have the number of door units to correspond to the number of discharge units. Hereinafter, the first door unit 60-1 will be described as an example, and a description of the first door unit 60-1 may include descriptions of the other door units 60-2 and 60-3.

The first door unit 60-1 is provided to open or close the first discharge unit 40-1 and to discharge air, of which heat has been exchanged, to the outside of the housing 10. More specifically, the first door unit 60-1 may open or close the first discharge unit 40-1 using a control of a controller (hereinafter, see FIG. 7) which will be described below and may control air, of which heat has been exchanged, to flow from at least one discharge unit among the first discharge unit 40-1 to the third discharge unit 40-3.

The first door unit 60-1 may be provided to be movable between a door opening position 60*a* at which the first discharge unit 40-1 is opened and a door closing position 60*b* at which the first discharge unit 40-1 is closed. Specifically, the first door unit 60-1 may be provided to be movable forward-backward between the door opening position 60*a* and the door closing position 60*b*.

The first door unit 60-1 may include a door blade 62 and a door operating unit 66 configured to operate the door blade 62.

The door blade 62 may be formed in a circular shape to correspond to the shape of the first discharge unit 40-1. When the first door unit 60-1 is positioned at the door opening position 60*a*, the door blade 62 is provided to be spaced apart from a guide opening 43 of a discharge guide 45, and when the first door unit 60-1 is positioned at the door closing position 60*b*, the door blade 62 is provided in contact with the guide opening 43 of the discharge guide 45 to close the first discharge unit 40-1.

The door blade 62 may include a blade body 63 provided in a circular shape to correspond to the first discharge unit 40-1 and a blade coupling unit 64 configured to extend from the blade body 63 and to be couple to the door operating unit 66.

The blade body 63 may be provided in a shape of a circular plate. One side surface of the blade body 63 may be provided toward the outside of the housing 10, and the other side may be provided toward the blower unit 30.

A display may be provided on one side surface of the blade body 63 to display an operating state of the air conditioner 1 or to manipulate the air conditioner 1.

The display may be provided with a plasma display panel, a liquid crystal display (LCD) panel, an electro luminescence (EL) panel, an electrophoretic display (EPD) panel, an electrochromic display (ECD) panel, a light emitting diode (LED) panel, an organic LED (OLED) panel, or the like. However, the display is not limited thereto, but may be implemented in various types known to those skilled in the art.

The door operating unit 66 may be provided such that the door blade 62 is movable. The door operating unit 66 may include a motor. The door operating unit 66 may be coupled to the blade coupling unit 64 of the door blade 62 to move the door blade 62.

In addition, the blower grill 34 may be disposed around the door operating unit 66, and air flowing from the blower fan 32 provided behind the blower grill 34 may pass through the blower grill 34 and may be discharged forward.

Hereinafter, an operation of the air conditioner 1 according to one embodiment will be described in detail.

Figure 4:
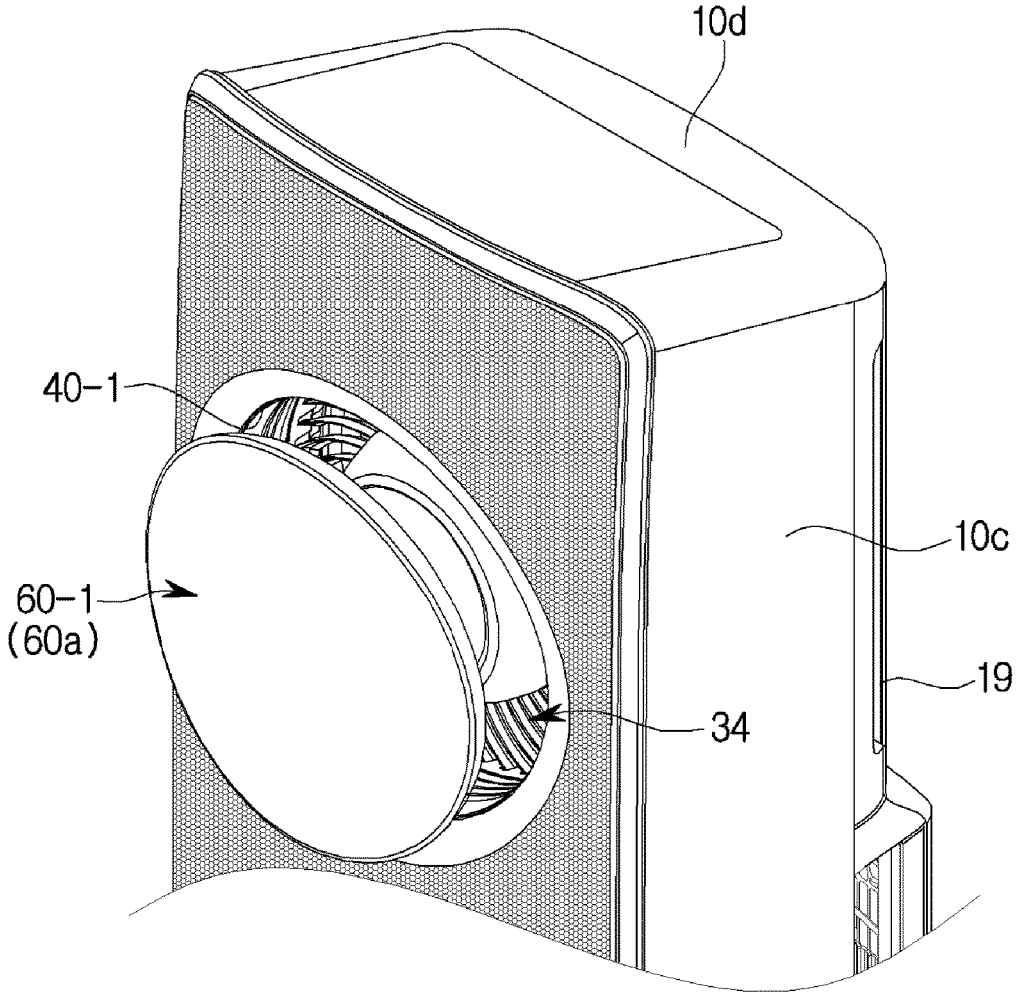
FIGS. 4, 5, and 6 are views illustrating an operation of the air conditioner according to various embodiments of the present disclosure.
Figure 5:
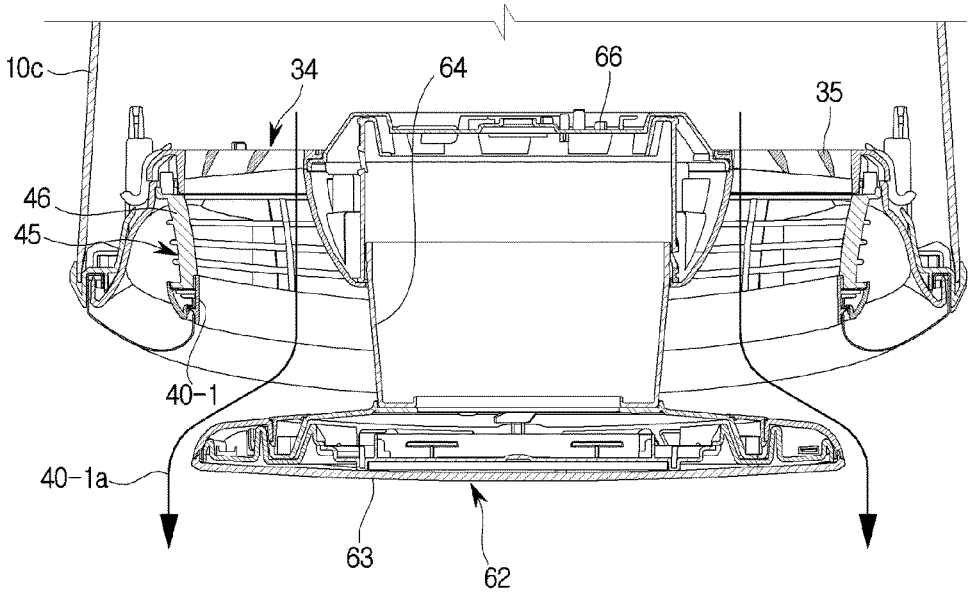
Figure 6:
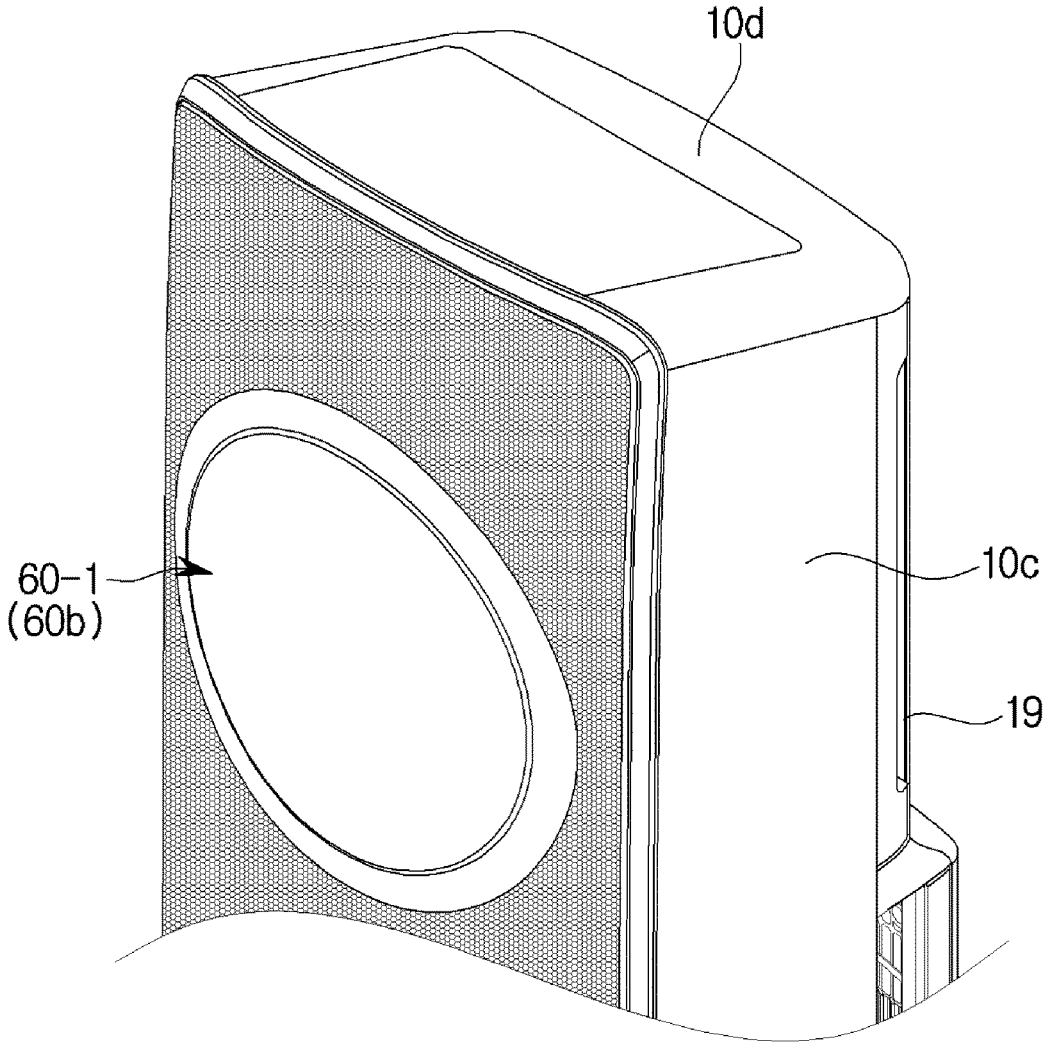

FIGS. 4, 5, and 6 are views illustrating an operation of the air conditioner 1 according to various embodiments of the present disclosure.

Referring to FIGS. 4, 5, and 6, air introduced into the housing 10 from the outside may exchange heat through the heat exchanger 20. The air which is air-conditioned by the heat exchanger 20 is discharged to the outside of the housing 10 by the blower unit 30.

The air conditioner 1 discharges air, which passed through the heat exchanger 20, to the outside through at least one discharge unit 40 among the first discharge unit 40-1 to the third discharge unit 40-3. That is, the air conditioner 1 may discharge air through at least one discharge unit 40 among the first to third discharge units 40-1, 40-2, and 40-3, and thus indoor air may be air-conditioned.

Each of the discharge units 40-1, 40-2, and 40-3 may be opened or closed by operating the door unit 60. When the first door unit 60-1 is positioned at the door opening position 60*a*, air of which heat has been exchanged may be discharged through the first discharge unit 40-1. With the same method, each of the second and third door units 60-2 and 60-3 is positioned at the door opening position 60*a*, air of which heat has been exchanged may be discharged through each of the second and third discharge units 40-2 and 40-3.

Each of the discharge units 40-1, 40-2, and 40-3 may be selectively opened according to a manipulation of a user, and a degree of opening may be adjusted according to a movement of the door unit 60. Hereinafter, an operation method of the door unit 60 may be described in detail with the first discharge unit 40-1 as an example.

FIGS. 4 and 5 are views illustrating an operation example of the air conditioner 1 when the door unit 60 of the air conditioner 1 is in an open state according to various embodiments of the present disclosure.

Referring to FIGS. 4 and 5, when the first door unit 60-1 is open, air of which heat has been exchanged may be discharged through the first discharge unit 40-1. In this case, the first door unit 60-1 is positioned at the door opening position 60*a*, the door blade 62 is separated from the guide opening 43, and thus the first discharge unit 40-1 is opened.

At this moment, the air flowing from the blower unit 30 flows to the first discharge unit 40-1 through a first discharging path 40-la formed by a guide body 46.

In addition, when air is discharged to the outside of the housing 10 through the first discharge unit 40-1, the air is discharged to the outside while a wind speed generated by the blower unit 30 is maintained.

Meanwhile, when an operation stop command for the air conditioner 1 is input, the first door unit 60-1 moves to the door closing position 60*b* as illustrated in FIG. 6.

At this moment, the air conditioner 1 may control a closing operation of the first door unit 60-1 such that the first door unit 60-1 stops at a position spaced a preset distance from the opening 17 and the closing operation is subsequently performed.

In addition, in some embodiments, the air conditioner 1 may control closing operations of the first to third door units 60-1, 60-2, and 60-3 such that the closing operations of the first to third door units 60-1, 60-2, and 60-3 are sequentially performed. Hereinafter, a closing operation of each of the door units 60-1, 60-2, and 60-3 will be described in detail with reference to a control block diagram which will be described below.

Figure 7:
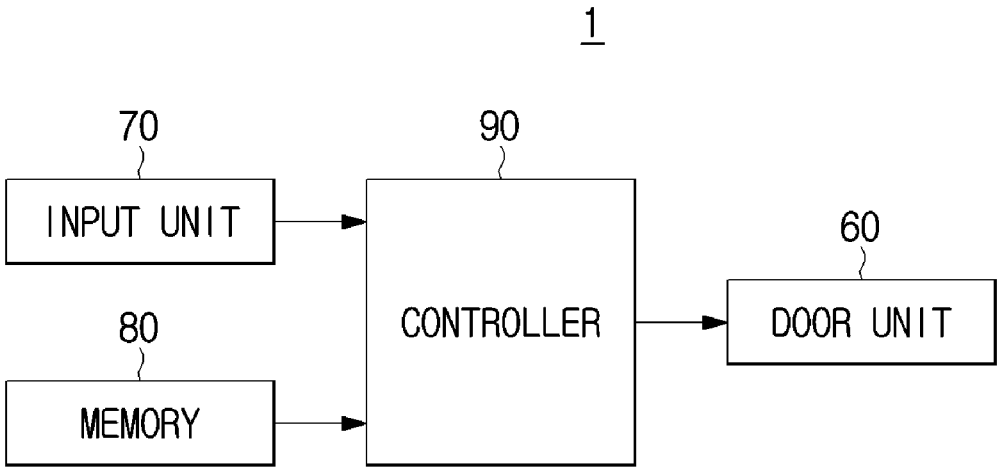
FIG. 7 is a control block diagram of the air conditioner according to an embodiment of the present disclosure.

FIG. 7 is a control block diagram of the air conditioner 1 according to an embodiment of the present disclosure.

Referring to FIG. 7, the air conditioner 1 according to one embodiment may include the door unit 60, an input unit 70, a memory 80, and a controller (e.g., at least one processor) 90.

The input unit 70 may receive a control command for the air conditioner 1 from a user. The input unit 70 may employ a graphic user interface (GUI) method, such as a hard key, a proximity sensor, or a touch pad method. When the input unit 70 employs the GUI method such as the touch pad or the like, the input unit 70 may be implemented as a touch screen panel and may also have a mutual layer structure with the display. However, an example of the input unit 70 is not limited thereto, and the input unit 70 may be implemented in various types known to those skilled in the art.

The memory 80 may store various types of data, control programs, or applications for driving and controlling the air conditioner 1. For example, the memory 80 may store control programs and applications for controlling the door unit 60 of the air conditioner 1.

The memory 80 may store user interfaces (UIs), objects (for example, images, text, icons, buttons, and the like) for providing the UIs, user information, text, databases, and relevant data related to the control program or application for controlling the air conditioner 1.

The memory 80 may include at least one type of storage medium among a flash memory type, a hard disk type, a multimedia card micro type, a card type memory (for example, a secure digital (SD), an extreme digital (XD) memory, or the like), a random access memory (RANI), a static RANI (SRAM), a read-only memory (ROM), an electrically erasable programmable ROM (EEPROM), a programmable ROM (PROM), a magnetic memory, a magnetic disk, and an optical disc. However, an example of the memory is not limited thereto, and the memory may be implemented in various types known to skilled in the art.

The controller 90 serves to control an overall operation of the air conditioner 1 and signal flows between internal components of the air conditioner 1 and to process data. The controller 90 may control an opening or closing operation of the door unit 60 of the air conditioner 1 when a control command for the air conditioner 1 is input by a user or the air conditioner 1 meets a preset condition.

The controller 90 may include a ROM configured to store processors, control programs or applications for controlling the air conditioner 1 and a RANI used as a storage medium configured to store signals or data input from an outside of the air conditioner 1 or to correspond to various operations performed in the air conditioner 1. Hereinafter, the concepts of the ROM and RAM of the controller 90 may include the concepts of the ROM and RAM of the memory 80.

The controller 90 may control an opening operation of the door unit 60 such that the door unit 60 is positioned at the door opening position 60*a* when an operation command for the air conditioner 1 is input by a user. The controller 90 may adjust an opening degree of the door unit 60 according to the operation command input by the user.

The controller 90 may control a closing operation of the door unit 60 such that the door unit 60 is positioned at the door closing position 60*b* when an operation stop command for the air conditioner 1 is input by the user. For example, when the door unit 60 reaches a position spaced a first distance, which is preset, from the opening 17 during a closing operation of the door unit 60, the controller 90 may control the door unit 60 to stop for a first time which is preset and the closing operation to be subsequently performed. Here, the first distance may be set to about 9 mm, and the first time may be set to about two seconds. However, setting examples of the first distance and first time are not limited thereto, and the first distance and first time may be variously adjusted by a user. According to the present disclosure, as a control process is added to stop the door unit 60 for a preset time during the closing operation of the door unit 60, a time for avoiding finger jamming may be provided for a user.

The controller 90 may control a closing speed of the door unit 60 to be different before and after the door unit 60 stops. For example, the controller 90 may control a closing speed of the door unit 60 before the door unit 60 stops to be a first speed which is preset, and may control a closing speed of the door unit 60 after the door unit 60 stops to be a second speed slower than the first speed. As the closing speed of the door unit 60 decreases after the door unit 60 stops, a conveying force of the door unit 60 decreases, and as a result, a control for injury protection for a user may be additionally provided.

The controller 90 may also control a closing operation of the door unit 60 such that a plurality of openings 17 are sequentially closed. For example, the controller 90 may control the closing operation of the door unit 60 such that the plurality of openings 17 are sequentially closed in a direction from an upper surface to a lower surface of the air conditioner 1. That is, the closing operation of the door unit 60 may be controlled such that the first door unit 60-1, the second door unit 60-2, and the third door unit 60-3 are sequentially closed. As the controller 90 sequentially controls the closing operations of the plurality of door units 60-1, 60-2, and 60-3, a time for avoiding finger jamming during the closing operations of the door units 60-1, 60-2, and 60-3 may be secured for a user.

Meanwhile, the above-described method of controlling the door units 60-1, 60-2, and 60-3 may be applied to the detailed method of controlling the door units 60-1, 60-2, and 60-3 in the same manner. That is, when the door unit 60 reach a position spaced a preset first distance from the openings 17, the controller 90 may control the closing operation of the door unit 60 to stop the door unit 60 for a preset first time and to perform a closing operation.

The air conditioner 1 according to one embodiment has been described as above. In the above-described air conditioner, a phenomenon of finger jamming of a user during a closing operation of door unit 60 can be prevented by only controlling an operation of the door unit 60 without installing additional sensors or units.

Hereinafter, a method of controlling the air conditioner 1 according to one embodiment will be described.

Figure 8:
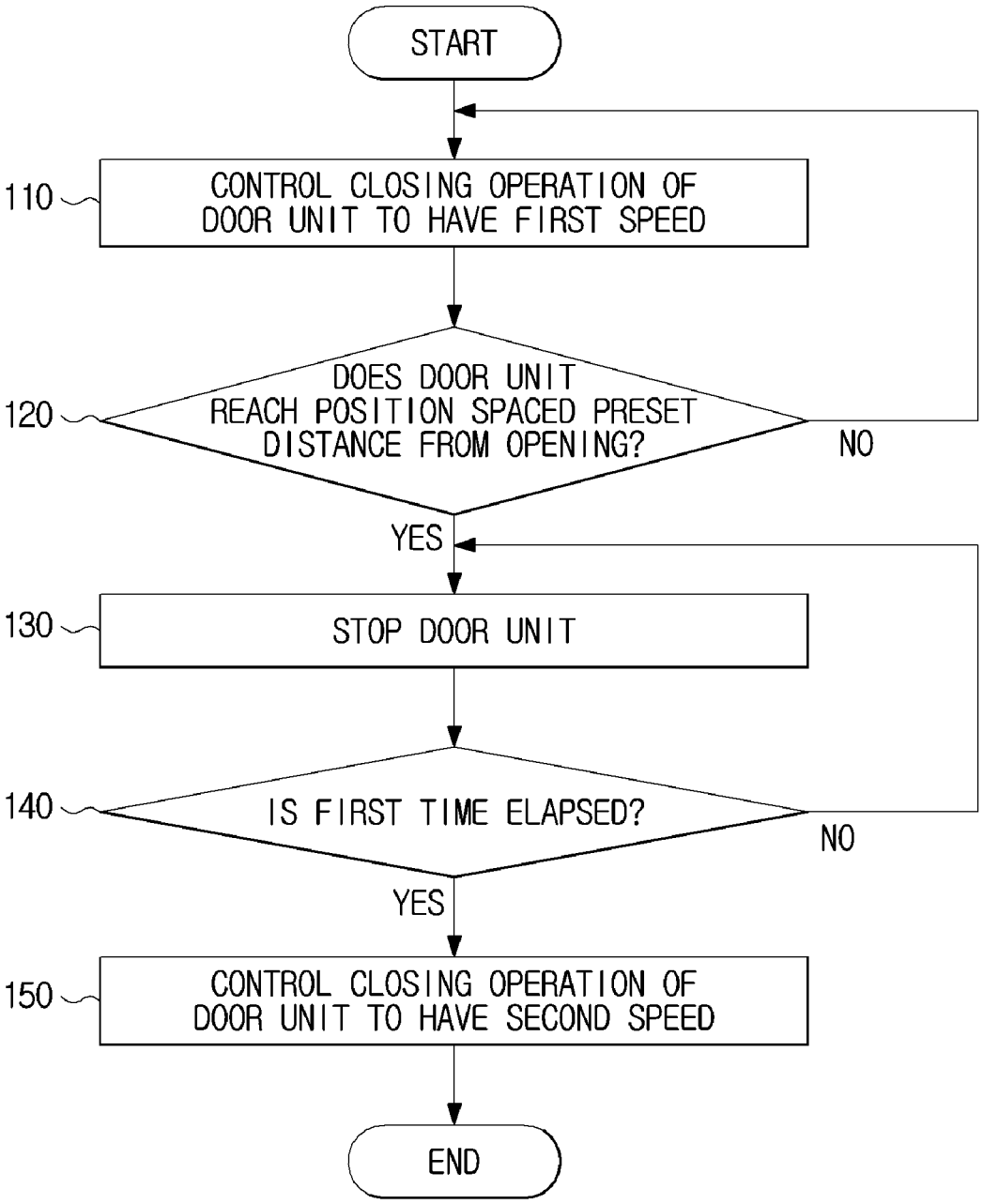
FIG. 8 is a flowchart illustrating an example of a control process of the air conditioner according to an embodiment of the present disclosure.
Figure 9:
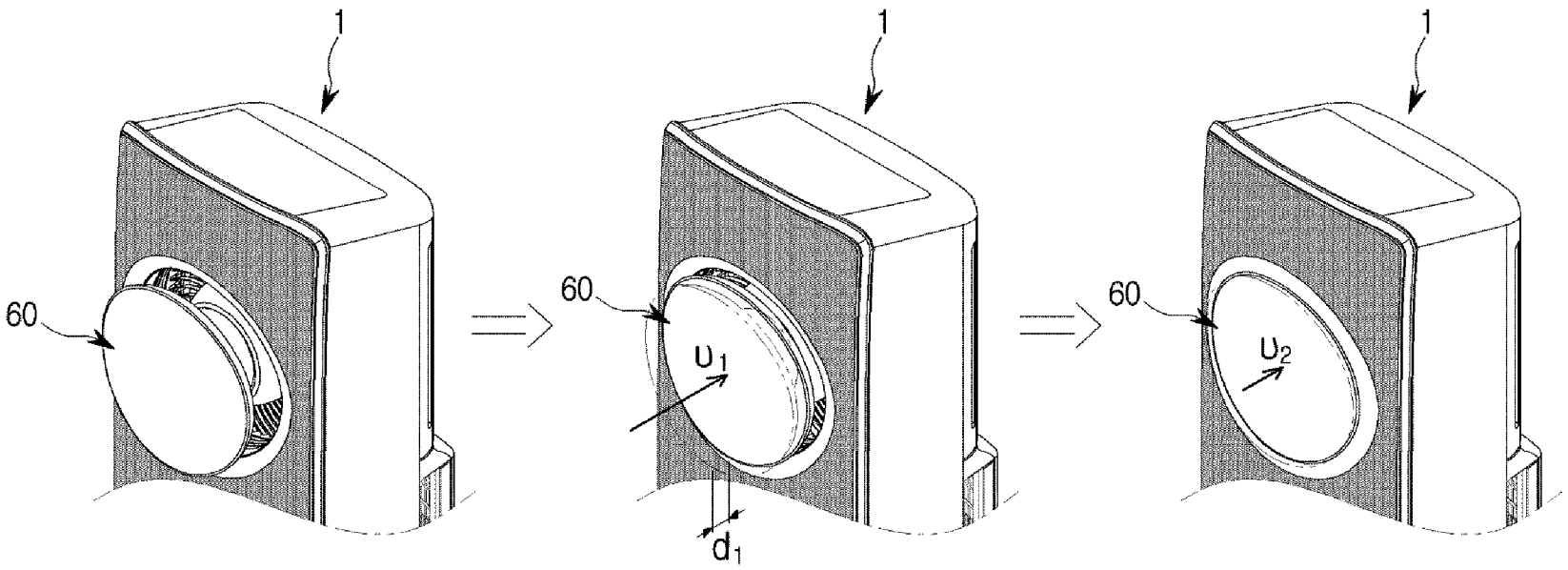
FIG. 9 is a view for describing the control process shown in FIG. 8 according to an embodiment of the present disclosure.

FIG. 8 is a flowchart illustrating an example of a control process of the air conditioner 1 according to an embodiment of the present disclosure, and FIG. 9 is a view for describing the control process shown in FIG. 8 according to an embodiment of the present disclosure.

Referring to FIGS. 8 and 9, the control process for the air conditioner 1 may include controlling a closing operation of the door unit 60 to have a first speed v1 which is preset at operation 110, controlling the door unit 60 to stop when the door unit 60 reaches a position spaced a preset first distance dl from the opening 17 at operations 120 and 130, and controlling the closing operation of the door unit 60 to have a second speed v2 which is preset when a preset first time elapses after the door unit 60 stops at operations 140 and 150.

First, when an operation stop command for the air conditioner 1 is input by a user, the controlling of the closing operation of the door unit 60 to have the preset first speed v1 may be performed at operation 110.

When the door unit 60 does not reach the position spaced the preset first distance dl from the opening 17, the controlling of the closing operation of the door unit 60 to have the preset first speed v1 may be subsequently performed at operations 120 and 110.

Next, when the door unit 60 reaches the position spaced the preset first distance dl from the opening 17, the controlling of the door unit 60 to stop for the preset first time may be performed at operations 120 and 130. Here, the first time may be set to two seconds but may vary according to user setting. According to the control method of the present disclosure, since a control process in which the door unit 60 stops for a preset time during a closing operation of the door unit 60 is added, a time for avoiding finger jamming may be provided for a user. Meanwhile, in some embodiments, the stopping of the door unit 60 may also be omitted. In this case, when the door unit reaches the position spaced the preset first distance from the opening, a process 150 which will be described below may be performed immediately.

When the first time does not elapse in a state in which the door unit 60 stops, the stopped state of the door unit 60 may be continuously maintained at operations 140 and 130.

When the first time elapses in the state in which the door unit 60 stops, controlling the closing operation of the door unit 60 to have a second speed v2 may be performed at operations 140 and 150. Here, the second v2 may be slower than the above-described first speed v1. As a closing speed of the door unit 60 decreases after the door unit 60 stops, a conveying force decreases during the closing operation of the door unit 60, and as a result, a control for injury protection for a user can be provided.

Figure 10:
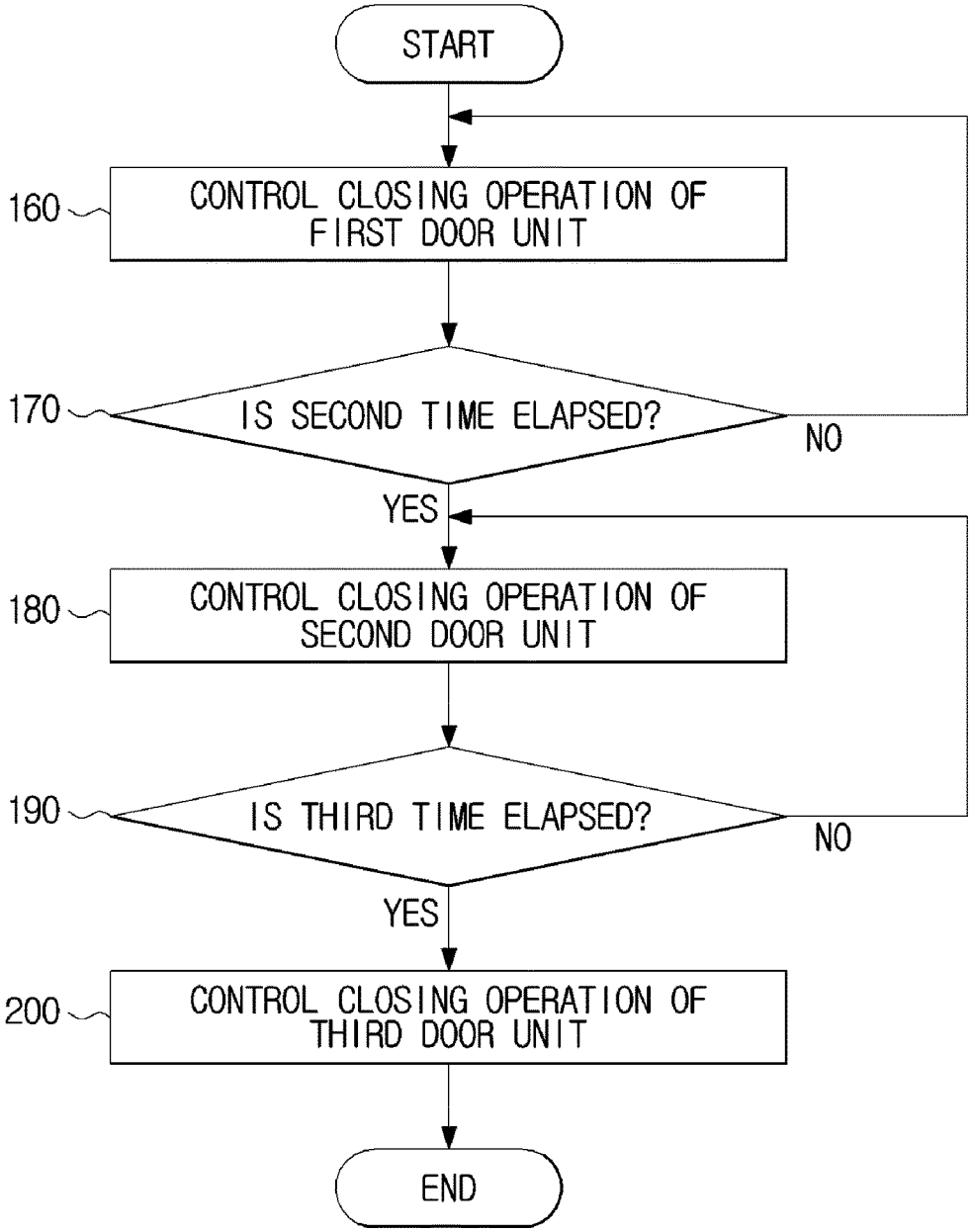
FIG. 10 is a flowchart illustrating another example of a control process of the air conditioner according to an embodiment of the present disclosure.
Figure 11:
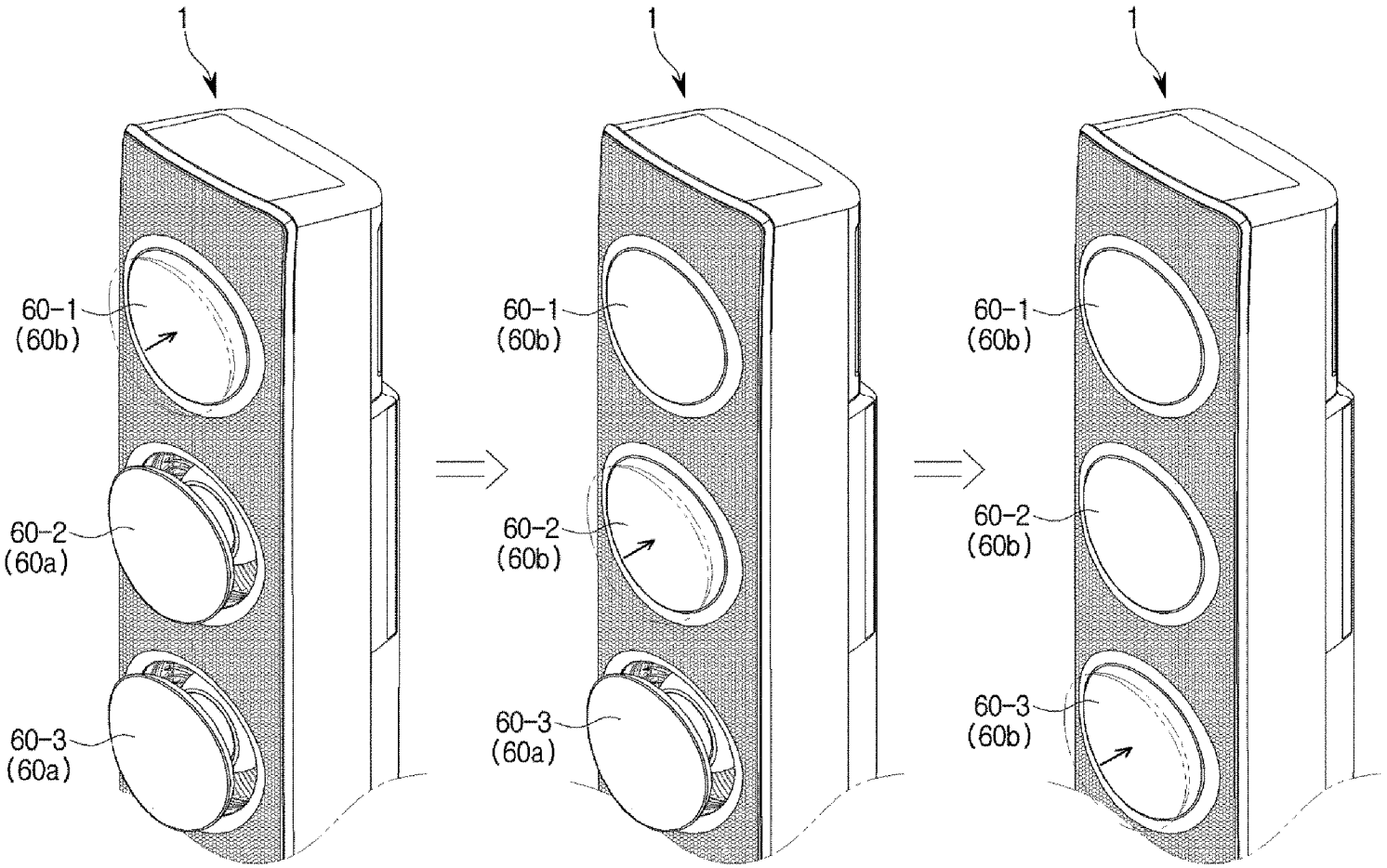
FIG. 11 is a view for describing the control process shown in FIG. 10 according to an embodiment of the present disclosure.

FIG. 10 is a flowchart illustrating another example of a control process of the air conditioner 1 according to an embodiment of the present disclosure, and FIG. 11 is a view for describing the control process shown in FIG. 10 according to an embodiment of the present disclosure. FIGS. 10 and 11 are illustrated based on a case in which a plurality of door units 60 are included, and hereinafter, the control process of the air conditioner 1 will be described based on a case in which the first to third door units 60 are included.

Referring to FIGS. 10 and 11, a method of controlling the air conditioner 1 according to another example of one embodiment sequentially performs closing controls for the plurality of door units 60-1, 60-2, and 60-3. That is, the method may include a process of sequential closing controls for the first to third door units 60-1, 60-2, and 60-3.

First, a control process of a closing operation of the first door unit 60-1 may be performed at operation 160. Here, the first door unit 60-1 may be a door unit 60, which is the most difficult for a user to access, among the plurality of door units 60, and for instance, may be a door unit 60 provided at a position adjacent to the upper panel 10*d* of the air conditioner 1. However, the door unit 60 that is controlled to be closed first may be arbitrarily changed by user setting.

When the closing operation of the first door unit 60-1 starts, the first door unit 60-1 may move from the door opening position 60*a* to the door closing position 60*b*.

When a second time which is preset elapses after the closing operating of the first door unit 60-1 starts, a control process of a closing operation of the second door unit 60-2 may be performed at operations 170 and 180. Here, the second time may be adjusted in the range of about three to ten seconds. However, a setting example of the second time is not limited thereto.

When the closing operation of the second door unit 60-2 starts, the second door unit 60-2 may move from the door opening position 60*a* to the door closing position 60*b*.

When a third time which is preset elapses after the closing operation of the second door unit 60-2 starts, a control process of a closing operation of the third door unit 60-3 may be performed at operations 190 and 200. Here, the third time may be set to be the same as the above-described second time or may also be set different from the above-described second time in some embodiments.

When the closing operation of the third door unit 60-3 starts, the third door unit 60-3 may move from the door opening position 60*a* to the door closing position 60*b*.

As the method of controlling the air conditioner 1 according to the present disclosure sequentially controls the closing operations of the plurality of door units 60-1, 60-2, and 60-3, a user can sufficiently secure a time for avoiding finger jamming during closing operations of the door units of the air conditioner.

As is apparent from the above description, according to an air conditioner and a method of controlling the same according to one aspect of the present disclosure, a phenomenon of finger jamming of a user can be prevented during closing operations of door units by controlling operations of the door units without installing additional sensors or units.

In addition, a user can secure a time for avoiding finger jamming during closing operations of door units of the air conditioner.

As described above, the air conditioner and the method of controlling the same according to one embodiment have been described. The technical concept of the present disclosure is not limited to the above-described embodiment, but may include changes in the range in which those skilled in the art may easily perform.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An air conditioner comprising:

a housing including a plurality of openings that are formed in the housing;

a plurality of door blades provided to be movable in proximity to the plurality of openings of the housing, and each of the plurality of door blades being configured to open and fully close a corresponding one of the plurality of openings; and at least one processor configured to:

control a closing operation of each of the plurality of door blades at a predetermined time interval such that each of the plurality of openings is fully closed sequentially at the predetermined time interval, control a first door blade of the plurality of door blades to stop at a position that is spaced a predetermined first distance from a first opening of the plurality of openings during a closing operation of the first door blade, in response to the controlling of the first door blade to stop at the position, start a timer which elapses after a predetermined first time, and in response to the timer elapsing after the predetermined first time, control the closing operation of the first door blade to fully close the first door blade.

2. The air conditioner of claim 1, wherein the at least one processor is further configured to control a first closing speed of the first door blade before the first door blade stops to be different than a second closing speed of the first door blade after the first door blade stops.

3. The air conditioner of claim 1, wherein the at least one processor is further configured to:

control a closing speed of the first door blade to be a predetermined first speed that occurs before the first door blade stops, and control another closing speed of the first door blade to be a predetermined second speed, which is slower than the predetermined first speed, that occurs after the first door blade stops.

4. The air conditioner of claim 1, wherein the at least one processor is further configured to control a closing speed of the first door blade after the first door blade stops to be slower than another closing speed of the first door blade before the first door blade stops.

5. The air conditioner of claim 1, wherein the at least one processor is further configured to control the plurality of door blades being sequentially fully closed in a direction from an upper surface of the air conditioner to a lower surface of the air conditioner.

6. A method of controlling an air conditioner, the air conditioner including a housing in which a plurality of openings are formed and a plurality of door blades configured to open and fully close the plurality of openings, the method comprising:

controlling a closing operation of each of the plurality of door blades at a predetermined time interval such that each of the plurality of openings is fully closed sequentially at the predetermined time interval;

controlling a closing operation of a first door blade of the plurality of door blades to have a predetermined first speed before the first door blade reaches a position that is spaced a predetermined first distance from a first opening of the plurality of openings, during a closing operation of the first door blade;

controlling the first door blade to stop, when the first door blade reaches the position that is spaced the predetermined first distance from the first opening;

in response to the controlling of the first door blade to stop, starting a timer which elapses after a predetermined first time; and in response to the timer elapsing after the predetermined first time, controlling the closing operation of the first door blade to have a predetermined second speed to fully close the first door blade.

7. The method of claim 6, wherein the controlling of the closing operation of the first door blade to have the predetermined second speed comprises controlling the closing operation of the first door blade to have the predetermined second speed slower than the predetermined first speed.

8. The method of claim 6, wherein the controlling of the closing operation of the plurality of door blades further comprises closing the plurality of door blades sequentially in a direction from an upper surface of the air conditioner to a lower surface of the air conditioner.

* * * * *